US006655446B2

(12) United States Patent
Liebermann et al.

(10) Patent No.: US 6,655,446 B2
(45) Date of Patent: Dec. 2, 2003

(54) APPARATUS AND METHOD FOR CASTING AMORPHOUS METAL ALLOYS IN AN ADJUSTABLE LOW DENSITY ATMOSPHERE

(75) Inventors: Howard H. Liebermann, Succasunna, NJ (US); Stephen D. Albert, Myrtle Beach, SC (US); Phillip L. Roberts, Conway, SC (US); David W. Palm, Conway, SC (US); Shinya Myojin, Myrtle Beach, SC (US)

(73) Assignee: Metglas, Inc., Conway, SC (US)

( * ) Notice: Subject to any disclaimer, the term of this patent is extended or adjusted under 35 U.S.C. 154(b) by 0 days.

(21) Appl. No.: 10/216,950

(22) Filed: Aug. 12, 2002

(65) Prior Publication Data

US 2002/0185256 A1 Dec. 12, 2002

Related U.S. Application Data

(62) Division of application No. 09/805,386, filed on Mar. 13, 2001, now Pat. No. 6,453,984.

(51) Int. Cl.[7] ..... B22D 11/00
(52) U.S. Cl. ..... 164/423; 164/415
(58) Field of Search ..... 164/463, 475, 164/423, 415, 67.1

(56) References Cited

U.S. PATENT DOCUMENTS

| | | | | |
|---|---|---|---|---|
| 4,282,921 | A | 8/1981 | Liebermann | 164/463 |
| 4,869,312 | A | 9/1989 | Liebermann et al. | 164/463 |
| 6,453,984 | B1 * | 9/2002 | Liebermann et al. | 164/463 |

FOREIGN PATENT DOCUMENTS

| | | |
|---|---|---|
| WO | WO 99/48635 | 9/1999 |

* cited by examiner

*Primary Examiner*—M. Alexandra Elve
*Assistant Examiner*—I.-H. Lin
(74) *Attorney, Agent, or Firm*—Ernest D. Buff & Associates, LLC; Ernest D. Buff; Gordon E. Fish

(57) ABSTRACT

An apparatus and method for casting metal strip includes a moving chill body that has a quench surface. A nozzle mechanism deposits a stream of molten metal on a quenching region of the quench surface to form the strip. The nozzle mechanism has an exit portion with a nozzle orifice. A depletion mechanism includes a plurality of independently controllable gas nozzles to supply a reducing gas to multiple zones of a depletion region located adjacent to and upstream from the quenching region. The gas flow profile can be controlled in each zone independently of controlling the gas flow in other zones. The reducing gas reacts exothermically to lower the density to provide a low density reducing atmosphere within the depletion and substantially prevent formation of gas pockets in the strip.

11 Claims, 18 Drawing Sheets

APPARATUS AND METHOD FOR CASTING AMORPHOUS METAL ALLOYS IN AN ADJUSTABLE LOW DENSITY ATMOSPHERE

This application is a divisional of application Ser. No. 09/805,386 Filed Mar. 13, 2001 and now issued as U.S. Pat. No. 6,453,984. The entire disclosure of the prior application (s) is hereby incorporated by reference in its entirety.

BACKGROUND OF THE INVENTION

The invention relates to the casting of metal strip directly from a melt, and more particularly to the rapid solidification of an amorphous metal alloy directly from a melt to form substantially continuous metal strip.

The casting of very smooth strip has been difficult with conventional devices because gas entrapped as pockets between the quench surface and the molten metal during quenching form gas surface defects. These defects, along with other factors, cause considerable roughness on the quench surface side as well as on the opposite, free surface side of the cast strip. In some cases, the surface defects actually extend through the strip, forming perforations therein. Additionally, the uniformity of these surface defects across the width of a cast metal strip can vary.

U.S. Pat. No. 4,142,571 issued to M. Narasimhan discloses a conventional apparatus and method for rapidly quenching a stream of molten metal to form continuous metal strip. The metal can be cast in an inert atmosphere or a partial vacuum.

U.S. Pat. Nos. 3,862,658 issued to J. Bedell and 4,202,404 issued to C. Carlson disclose flexible belts employed to prolong contact of cast metal filament with a quench surface.

U.S. Pat. No. 4,154,283 to R. Ray et al. discloses that vacuum casting of metal strip reduces the formation of gas pocket defects. The vacuum casting system taught by Ray et al. requires specialized chambers and pumps to produce a low pressure casting atmosphere. In addition, auxiliary means are required to continuously transport the cast strip out of the vacuum chamber. Further, in such a vacuum casting system, the strip tends to weld excessively to the quench surface instead of breaking away as typically happens when casting in an ambient atmosphere.

U.S. Pat. No. 4,301,855 issued to H. Suzuki et al. discloses an apparatus for casting metal ribbon wherein the molten metal is poured from a heated nozzle onto the outer peripheral surface of a rotary roll. A cover encloses the roll surface upstream of the nozzle to provide a chamber, the atmosphere of which is evacuated by a vacuum pump. A heating element in the cover warms the roll surface upstream from the nozzle to remove dew droplets and gases from the roll surface. The vacuum chamber lowers the density of the moving gas layer next to the casting roll surface, thereby decreasing formation of air pocket depressions in the cast ribbon. The heating element helps drive off moisture and adhered gases from the roll surface to further decrease formation of air pocket depressions. The apparatus disclosed by Suzuki et al. does not pour metal onto the casting surface until that surface has exited the vacuum chamber. By this procedure, complications involved in removing a rapidly advancing ribbon from the vacuum chamber are avoided. The ribbon is actually cast in the open atmosphere, offsetting any potential improvement in ribbon quality.

U.S. Pat. No. 3,861,450 to Mobley, et al. discloses a method and apparatus for making metal filament. A disk-like, heat-extracting member rotates to dip an edge surface thereof into a molten pool, and a non-oxidizing gas is introduced at a critical process region where the moving surface enters the melt. This non-oxidizing gas can be a reducing gas, the combustion of which in the atmosphere yields reducing or nonoxidizing combustion products at the critical process region. In a particular embodiment, a cover composed of carbon or graphite encloses a portion of the disk and reacts with the oxygen adjacent to the cover to produce non-oxidizing carbon monoxide and carbon dioxide gases, which can then surround the disk portion and the entry region of the melt.

The introduction of non-oxidizing gas as taught by Mobley, et al., disrupts and replaces an adherent layer of oxidizing gas with the non-oxidizing gas. The controlled introduction of non-oxidizing gas also provides a barrier to prevent particulate solid materials on the melt surface from collecting at the critical process region where the rotating disk would drag the impurities into the melt to the point of initial filament solidification. Finally, the exclusion of oxidizing gas and floating contaminants from the critical region increases the stability of the filament release point from the rotating disk by decreasing the adhesion there between and promoting spontaneous release.

Mobley, et al., however, address only the problem of oxidation at the disk surface and in the melt. The flowing stream of non-oxidizing gas taught by Mobley, et al. is still drawn into the molten pool by the viscous drag of the rotating wheel and can separate the melt from the disk edge to momentarily disturb filament formation. The particular advantage provided by Mobley, et al., is that the non-oxidizing gas decreases the oxidation at the actual point of filament formation within the melt pool. Thus, Mobley, et al. fail to minimize the entrainment of gas that could separate and insulate the disk surface from the melt and thereby reduce localized quenching.

U.S. Pat. Nos. 4,282,921 and 4,262,734 issued to H. Liebermann disclose an apparatus and method in which coaxial gas jets are employed to reduce edge defects in rapidly quenched amorphous metal strips. U.S. Pat. Nos. 4,177,856 and 4,144,926 issued to H. Liebermann disclose a method and apparatus in which a Reynolds number parameter is controlled to reduce edge defects in rapidly quenched amorphous strip. Gas densities and thus Reynolds numbers, are regulated by the use of vacuum and by employing lower molecular weight gases.

U.S. Pat. No. 4,869,312 issued to H. Liebermann et al. discloses an apparatus and method for casting metal strip to reduce surface defects caused by the entrapment of gas pockets. A nozzle mechanism deposits a stream of molten metal within a quenching region of a quench surface to form a metal strip. A reducing gas is supplied to a depletion region located adjacent and upstream of the quenching region. The reducing gas reacts exothermically to provide a low density reducing atmosphere within the depletion region and to help prevent the formation of gas pockets in the strip.

Conventional methods, however, have been unable to adequately reduce the variation in surface defects across the width of a metal strip. Other shortcomings also exist in the prior art that are addressed and overcome by the present invention.

SUMMARY OF THE INVENTION

In one aspect, a method for casting continuous metal strip is disclosed. A chill body having a quench surface is moved at a selected speed, and a stream of molten metal is deposited on a quenching region of the quench surface to form the strip. Reducing gas is supplied to a depletion region located adjacent to and upstream from the quenching region. The reducing gas is provided by multiple gas nozzles, which may be separated from each other by baffles. A valve independently controls the flow of gas through each gas nozzle. The reducing gas is reacted exothermically to lower the density thereof and to provide a low density reducing atmosphere within the depletion region of each zone, independently. In a preferred embodiment, the metal strip is an amorphous metal alloy.

In a second aspect, a system is disclosed, which includes a casting surface such as a wheel, a molten metal supply, a reducing gas supply, a gas manifold including a plurality of independently controllable gas nozzles, and a plurality of gas flow control devices. The system provides for improved uniformity in the thickness profile of cast metal strip by allowing independent adjustment of gas flow to various regions in a depletion region. The system also provides for controlling both deleterious and advantageous ribbon surface features.

A third aspect includes an apparatus, which includes a casing with one open side, and several discrete compartments inside the casing separated by baffles. Each discrete compartment includes a gas nozzle. Gas nozzles are connected to a reducing gas supply via independently controllable valves. This arrangement allows the amount of gas flow to each discrete compartment to be controlled independently thereby providing a series of individual combustion chambers. This permits closer control of a strip's thickness profile and surface features over specific areas of the metal strip.

Another aspect includes a method of controlling gas flow to various discrete sections of a quenching region in a metal strip casting system, which aspect includes using a sensor to evaluate the quality of a cast metal strip. This method of control permits automatic adjustment of the reducing flame atmosphere in various discrete sections of a quenching region independently.

The techniques disclosed advantageously minimize the formation and entrapment of gas pockets between the quenched surface and metal during the casting of metal strip and provide uniformity of strip thickness and uniformity of smoothness across the width of the strip.

There are other aspects of the invention that will be described herein.

BRIEF DESCRIPTION OF THE DRAWINGS

The invention will be more fully understood and further advantages will become apparent when reference is made to the following detailed description and the accompanying drawings in which.

DETAILED DESCRIPTION

For the purposes of the present invention and as used in the specification and claims, a "strip" is to be understood as being a slender body the transverse dimensions of which are much smaller than its length. Thus, it is to be understood that the term "strip" includes wire, ribbon, sheet and the like of both regular and irregular cross-section. The height or thickness of the strip, particularly when a planar strip (i.e. ribbon, foil, tape, etc.) is usually less than the width, and the width is typically far less than the length.

The invention is suitable for casting metal strip, which ultimately is either crystalline or amorphous in nature. Opposed to crystalline metals, amorphous metals lack long range crystalline structure and are glassy in nature. Ideally, the amorphous metal compositions are at least 80% non-crystalline, preferably at least 90%, yet more preferably at least 95% and most preferably at least 98% non-crystalline in nature. The degree of crystallinity can be confirmed by known techniques. Amorphous metals include those which are rapidly solidified and quenched at a rate of at least about 104° C./sec from a supply of molten metal. Such a rapidly solidified amorphous metal strip usually provides improved physical properties, such as one or more of: improved tensile strength; improved ductility; improved corrosion resistance; and enhanced magnetic properties.

Figure 1:
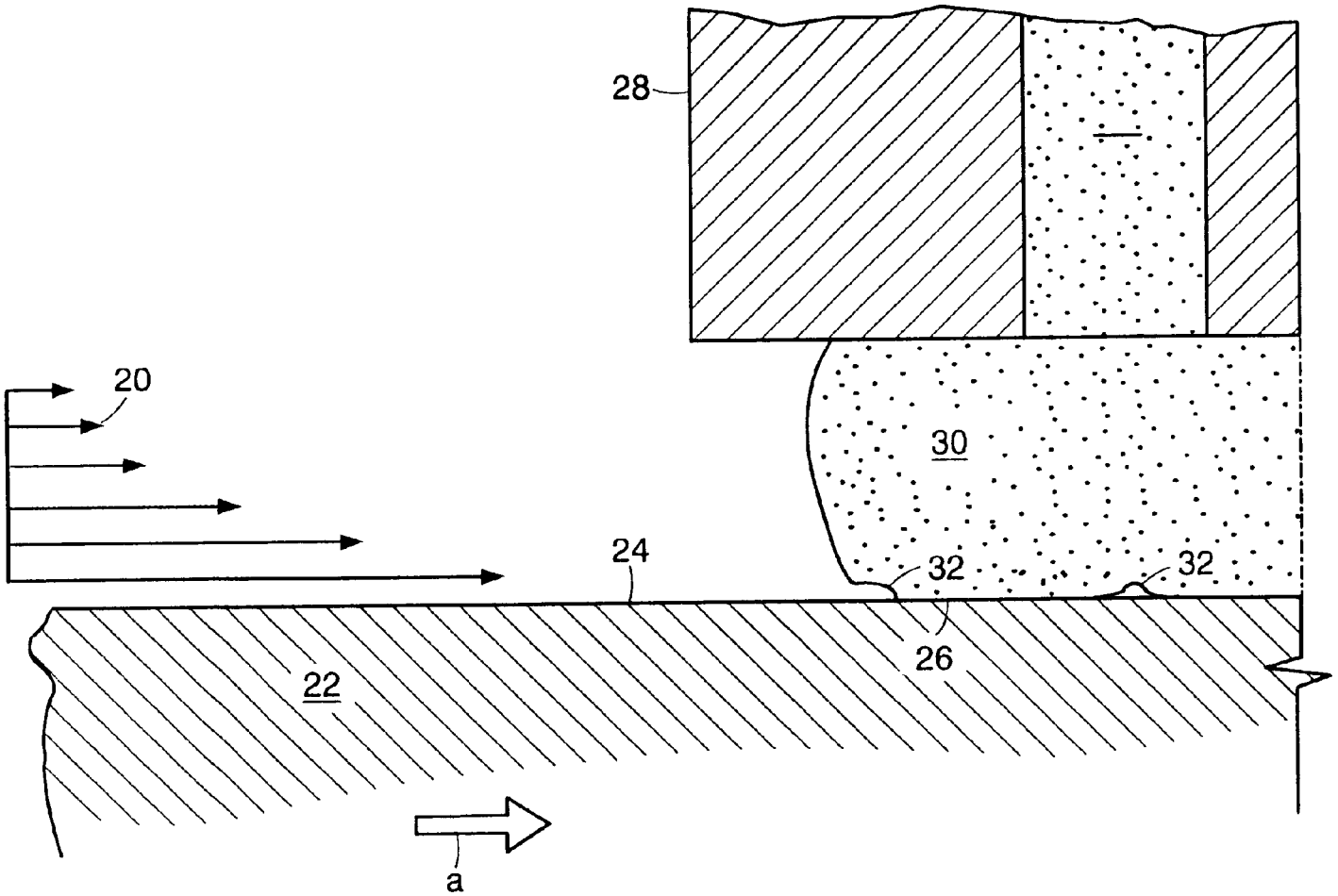
FIG. 1 shows the gas boundary layer velocity profile at a quench surface portion on which molten metal is deposited.

FIG. 1 illustrates a gas boundary layer velocity profile 20 at a portion of a quench surface 22 on which molten metal is being deposited. The gas boundary layer velocity profile 20 represents the ambient air being drawn around the periphery of the moving quench surface 22. The maximum gas boundary layer velocity occurs immediately adjacent to the quench surface 22 and is equal to the velocity of the moving quench surface 22. The quench surface 22 is moving in the direction indicated by arrow "a". As can be seen in FIG. 1, the moving quench surface 22 draws cool air from the ambient atmosphere into a depletion region 24 and into a quenching region 26, the latter of which is the region of the quench surface 22 upon which a molten metal melt puddle 30 is deposited. The heat generated by the hot casting nozzle 28 and the melt puddle 30 does not significantly reduce the ambient atmospheric density of the depletion region 24, because of the rapid rate at which boundary layer gas is entrained into the quenching region 26. This is particularly evident when it is understood that very high rotational and/or linear speeds of the quench surface may be required in order to achieve the high cooling rates required to form amorphous metal strip.

The quench surface 22 is typically comprised of a substrate, often a smooth, chilled metal. The melt puddle 30 wets the substrate surface to an extent determined by various factors including the metal alloy composition, the substrate composition, and the presence of films on the surface of the substrate. The pressure exerted by the gas boundary layer at the melt-substrate interface, however, acts to locally separate the melt from the substrate and form entrained gas pockets 32 in the underside of the melt puddle 30. These gas pockets 32 are undesirable.

In order to reduce the size of or number of gas pockets 32 entrained under the melt puddle 30, either the gas density must be reduced or the substrate velocity must be reduced. Reducing the substrate velocity is typically not practical because the cooling rate of the strip 36 may be detrimentally affected. Therefore, the gas density must be reduced. This can be accomplished in several possible ways. Casting in vacuum can eliminate the gas pockets 32 in the strip underside by removing the gas boundary layer. Alternatively, forcing a low-density gas into the boundary layer could be effective in reducing the size and number of gas pockets entrained under the melt puddle 30. The use of a low density gas (such as helium) is one way to reduce boundary layer gas density. Alternately, a low density reducing gas may be provided by exothermically reacting, viz, combusting a reducing gas. As the exothermic reaction of the gas proceeds, heat provided by the reaction also causes the density of the combusted gas to diminish as the inverse of the absolute temperature. By exothermically reacting a gas in the depletion region 24 on the upstream side of the melt puddle 30, the size and the number of entrained gas pockets 32 under the melt puddle can be substantially reduced.

Figure 2:
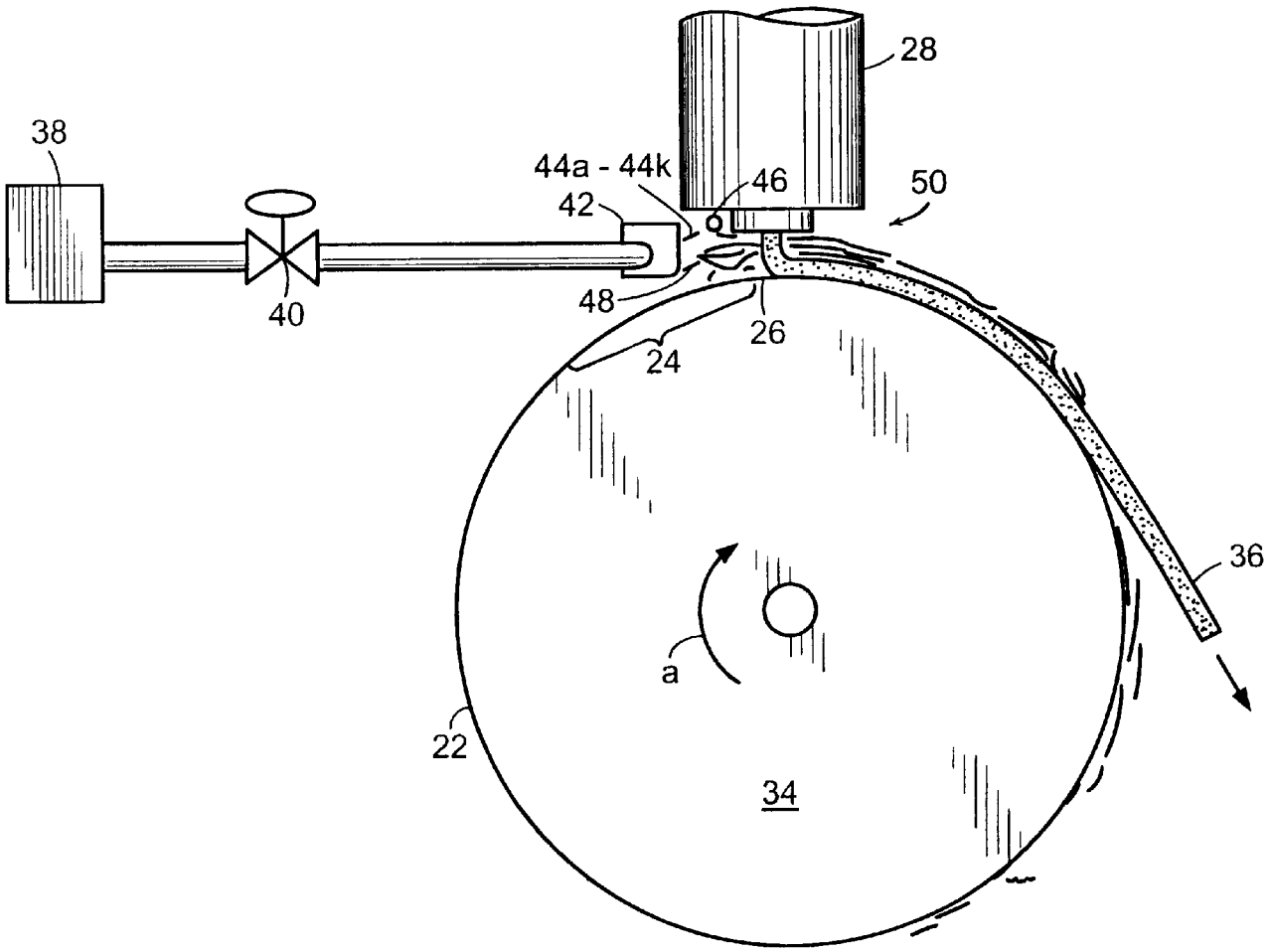
FIG. 2 PRIOR ART
FIG. 2 illustrates a representative embodiment of a prior art casting system.

FIG. 2 illustrates a representative embodiment of a prior art casting system wherein a gas, capable of being ignited and burned, is used to form a low density reducing gas. The casting nozzle 28 deposits molten metal onto a quench surface 22 of the rotating casting wheel 34 to form a strip 36. Depletion is achieved by use of a gas supply 38, a gas valve 40, a gas manifold 42 including multiple holes 44*a*–44*k*, and an ignition means 46. The gas valve 40 regulates the volume and velocity of gas delivered through the holes 44*a*–44*k*. After the gas 48 has mixed with sufficient oxygen to ensure combustion, the ignition means 46 ignites the gas 48 to produce a heated, low-density reducing gas around the depletion region 24 and around the quenching region 26 where the molten metal is deposited. The ignition means 46 may include, for example, spark ignition, hot filament, hot plates, or the molten metal casting nozzle itself, which is often sufficiently hot to ignite the gas 48.

Figure 3:
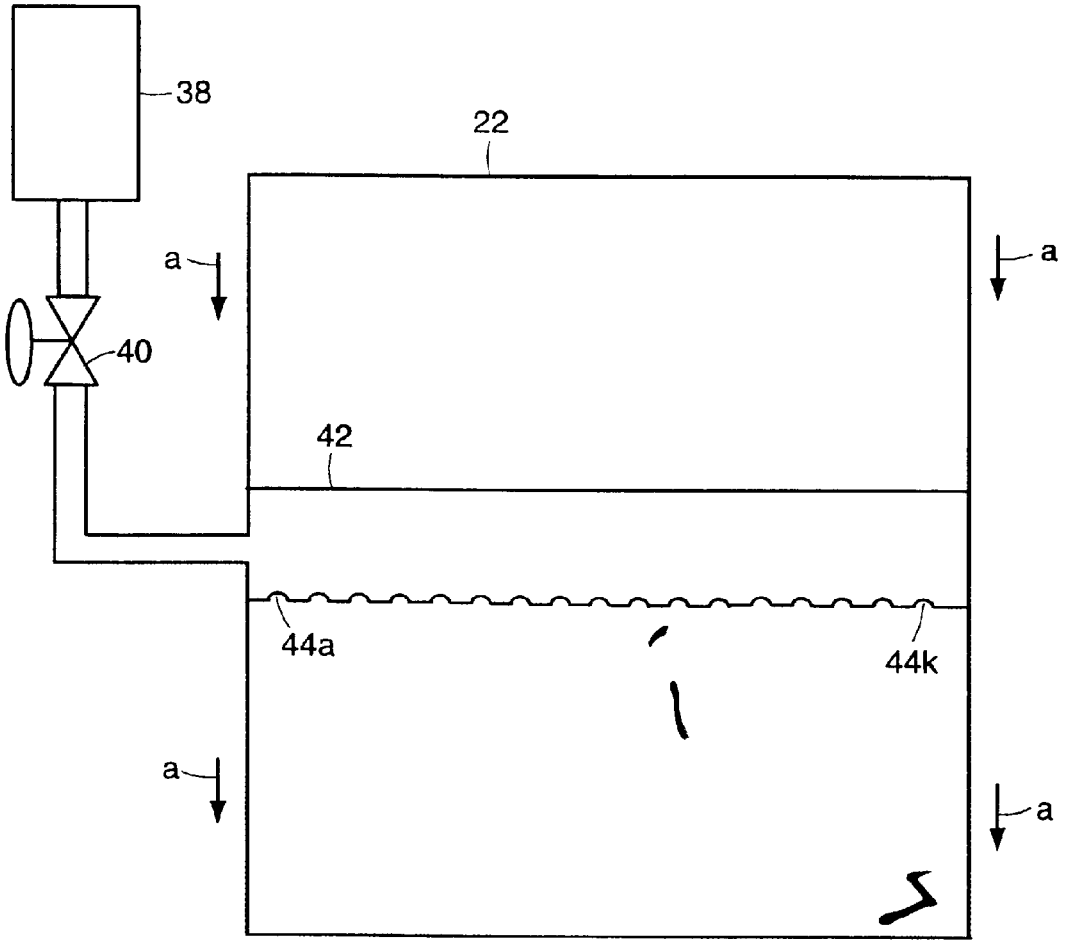
FIG. 3 PRIOR ART
FIG. 3 illustrates a portion of the prior art casting system of FIG. 2.

FIG. 3 illustrates an alternate view of a portion of the prior art casting system shown in FIG. 2. A single valve 40 controls the flow of gas from a gas supply 38 to a manifold 42, which provides gas to multiple holes 44*a*–44*k*. The gas valve 40 is a single point of control, which provides an adjustable, but substantially uniform gas flow rate exiting the holes 44*a*–44*k*.

Referring again to FIG. 2, when the gas is ignited, it forms a flame that desirably extends sufficiently far to contact the casting nozzle 28 and the strip 36. The flame plume 50 extends beyond the end of the flame and is a low density gas. The flame plume 50 typically begins upstream of the quenching region 26. The gas combustion process consumes oxygen from the ambient atmosphere. In addition, unburned gas, which may be present within the flame plume 50, reacts to reduce the oxides on the quench surface 22, on the casting nozzle 28, and on the strip 36. The visibility of the flame plume 50 allows easy optimization and control of the gas flow, and the flame plume 50 is effectively drawn around a portion of the periphery of the wheel 34 by the motion of the quench surface 22. The quench surface 22 may be a wheel, a belt or any other convenient surface. A flame plume 50 is present at the quenching region 26 and for a discrete distance thereafter. The flame plume 50 advantageously provides a non-oxidizing, protective atmosphere around the casting nozzle 28 and the strip 36 while it is cooling.

The prior art techniques of FIGS. 2–3 typically introduce exothermically reacted reducing gases using multiple holes 44*a*–44*k* wherein the gas flow rate through these holes is controlled by one common control valve 40. This results in providing a non-variable flame atmosphere across the entire width of the strip 36. Such an arrangement can be used to influence a strip's thickness profile uniformly across its width by adjusting the gas flow rate via the control valve 40. The resulting casting behavior and physical properties of the strip can be somewhat influenced in this manner, however, further improvements are sought and desired in this art.

The present invention provides an effective method and apparatus to control gas flow and the resulting flame independently in discrete sections of a nozzle assembly, thus enabling properties in discrete sections of the cast metal strip to be influenced independently without affecting other sections. Further aspects and advantages of the invention will also be described.

The terms "flame plume" and "low density reducing atmosphere", as used in the specification and claims thereof, means a reducing atmosphere having a gas density less than approximately 1 gram per liter and preferably, having a gas density of less than approximately 0.5 grams per liter when the casting system is in an environment that is otherwise at normal atmospheric pressure.

To obtain the desired low density reducing atmosphere, gas 48 is exothermically reacted, viz combusted, at a temperature of at least about 800 K, and more preferably, is exothermically reacted to a temperature of at least about 1200 K. In general, hotter burning gases are preferred because they may have lower densities and greater reducing power and thus may better minimize the formation of gas pockets 32 in the deposited molten metal.

Entrapped gas pockets 32 are undesirable because they produce surface defects on metal strips 36 that may degrade the surface smoothness and may adversely affect other properties of the metal strip 36. In extreme cases, the gas pockets 32 may cause perforations through the strip 36. A very smooth surface finish is particularly important when winding magnetic metal strip 36 for magnetic cores because surface defects reduce the packing factor of the material. Packing factor is a volumetric fraction or volumetric percentage that indicates the apparent density of a wound core and is equal to the volume of magnetic material in the wound core divided by the total wound core volume. Packing factors are often expressed as a percentage (%), with the ideal packing factor being 100%. A smooth surface without defects is also important in optimizing the magnetic properties of a strip 36 and in minimizing localized stress concentrations that would otherwise reduce the mechanical strength of the strip.

Gas pockets 32 also locally insulate the deposited molten metal from the quench surface 22 and thereby reduce the quench rate in these localized areas. The resultant, non-uniform quenching typically produces non-uniform physical and magnetic properties in the strip 36, such as non-uniform strength, ductility and high core loss or exciting power. When casting amorphous metal strip 36, gas pockets 32 can allow undesired crystallization to occur in localized portions of the strip 36. The gas pockets 32 and the local crystallizations produce discontinuities, which inhibit the mobility of magnetic domain walls, thereby degrading the magnetic properties of the material. Thus, by reducing the entrapment of gas pockets 32, the invention may provide high quality metal strip 36 with improved surface finish and improved physical and magnetic properties. For example, metal strip 36 has been produced with packing factors of at least about 80%, and up to about 95%.

Figure 4:
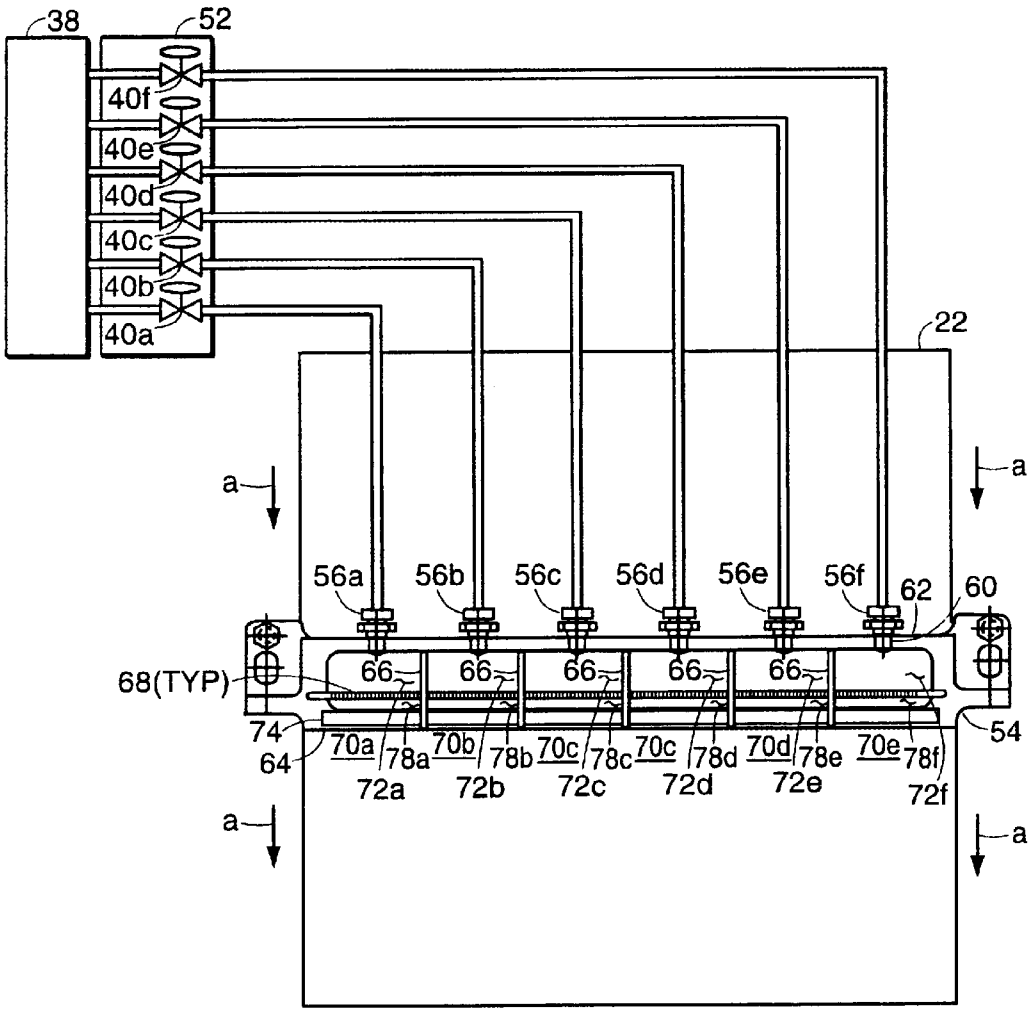
FIG. 4 illustrates a cutaway plan view of a casting system according to the invention.
Figure 5:
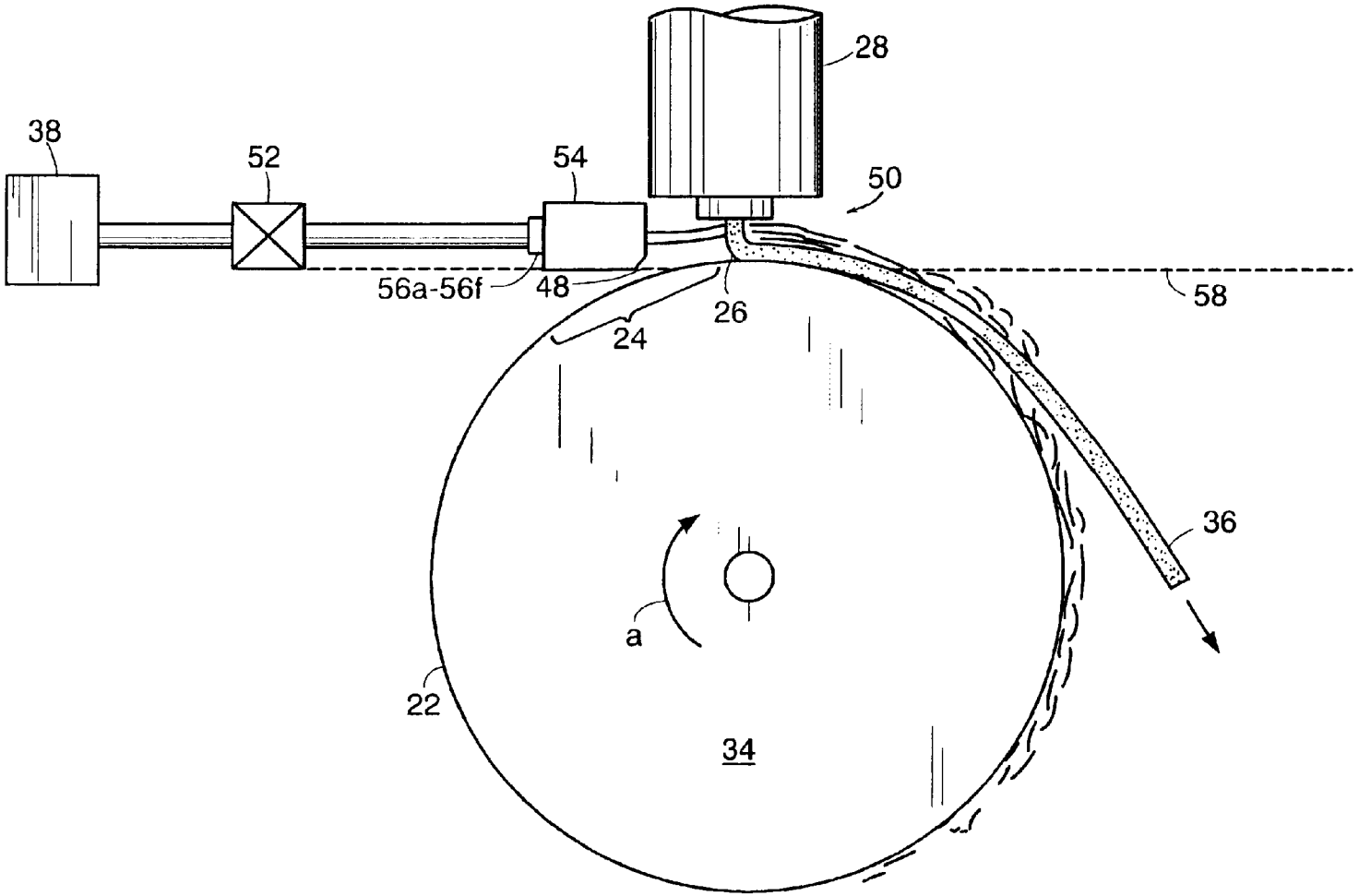
FIG. 5 illustrates a side view of a casting system according to the invention.

FIGS. 4 and 5 illustrate alternate views of a casting system according to the invention that includes a gas supply 38 connected to a gas valve manifold 52. The gas valve manifold 52 includes multiple gas valves 40*a*–40*f*. These multiple gas valves 40*a*–40*f* control the flow of gas to a burner manifold 54. The burner manifold 54 is adapted to accommodate multiple burner nozzles 56*a*–56*f* each with independent supply lines. Each burner nozzle 56*a*–56*f* is supplied gas independently. This particular embodiment illustrates six separate burner nozzles 56*a*–56*f*, but it should be understood that any number of nozzles could be implemented to achieve desired results. Spacing between each nozzle can also vary and uniform spacing is not a requirement.

It is preferable that the gas 48 flow be directed towards the quench surface 22 at an angle of between 0° and 90° from an imaginary line 58 that is tangent to the quench surface 22 and which intersects the quench surface 22 at the point where the molten metal is deposited onto the quench surface 22. More preferably, the flow of the gas 48 should be directed towards the quench surface 22 at an angle of between 20° and 70° from the imaginary line 58. Each burner nozzle 56*a*–56*f* may have a corresponding ignition means. The ignition means may be, for example, spark ignition, hot filament, hot plates, or it may be the casting nozzle 28 itself. Also multiple nozzles may share a single ignition means. FIGS. 4 and 5 illustrate a casting wheel 34, but any type of casting surface can be used.

In a preferred embodiment, the burner manifold 54 includes multiple passages 60 on one wall 62 dimensioned to accommodate gas nozzles 56*a*–56*f*. A wall 64 on the opposite side of the burner manifold 54 is closed. A series of baffles 66 are configured dividing the interior of the burner manifold 54 into separate chambers that prevent the gas flowing from each burner nozzle 56*a*–56*f* from mixing with gas flowing from adjacent burner nozzles 56*a*–56*f*.

At least one set of diffuser plates 68, substantially perpendicular to the direction of gas flow through the burner nozzles 56*a*–56*f* and parallel to the wall 62, is included in the interior of the burner manifold 54. This set of diffuser plates 68 typically has multiple small holes. The purpose of the diffuser plate 68 is to even out the pressure profiles across the width of each individual combustion zone 70*a*–70*f*. Multiple diffuser plates 68 may be installed to further even out the pressure profiles.

Gas 48 flows from the gas supply 38 through independently adjustable valves 40*a*–40*f*, through independent tubing and to the gas nozzles 56*a*–56*f*. The gas 48 flows through the gas nozzles 56*a*–56*f* and into primary chambers 72*a*–72*f*. The gas 48 flows through a diffuser plate 68, and into a secondary chamber 78*a*–78*f*. The gas 48 continues through the exit slot 74. The gas 48 combusts when it mixes with sufficient oxygen to support combustion. The combusted gas 48 flows into the depletion region 24 and then into the quench region 26 where the molten metal meets the quench surface 22.

The arrangement illustrated in FIG. 4 and FIG. 5 provides independent control of gas flow to the various zones 70*a*–70*f* across the width of the depletion region 24. This independent control feature allows adjustments to be made to correct deficiencies in one area of a strip 36 without affecting the thickness profile in other areas of the strip 36.

Of course, this arrangement may be modified in various ways, and still provide functions in accordance with the inventive teachings. For example: multiple nozzles 56*a*–56*f* can be present within one or more primary chambers 72*a*–72*f*; the control valves 40*a*–40*f* may be integrated into the construction of the burner nozzles 56*a*–56*f* or the casing of the burner manifold 54. Other modifications are also possible.

Figure 6:
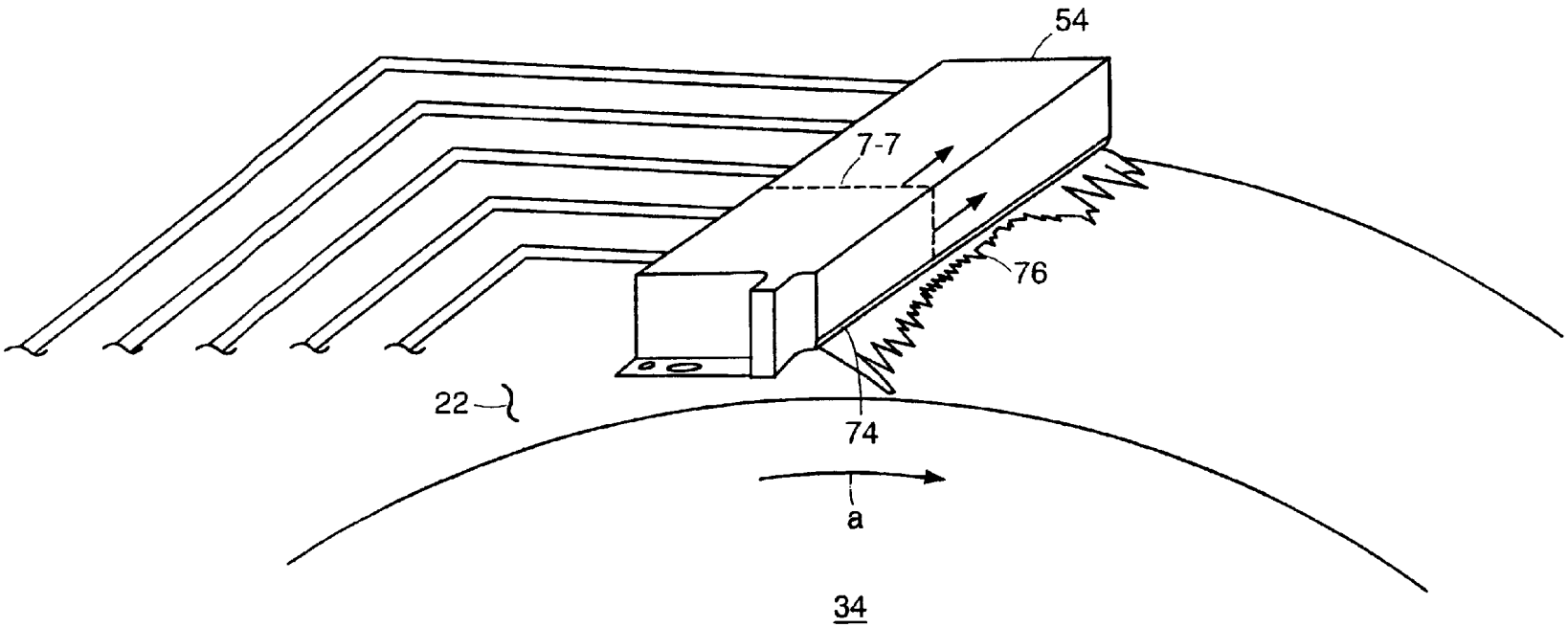
FIG. 6 illustrates a perspective view of a casting system according to the invention.

FIG. 6 illustrates a perspective view of a burner manifold 54 according to the invention. A flame 76 extends from the exit slot 74 of the burner manifold 54. The exit slot 74 is cut into a beveled corner of the burner manifold 54.

Figure 7:
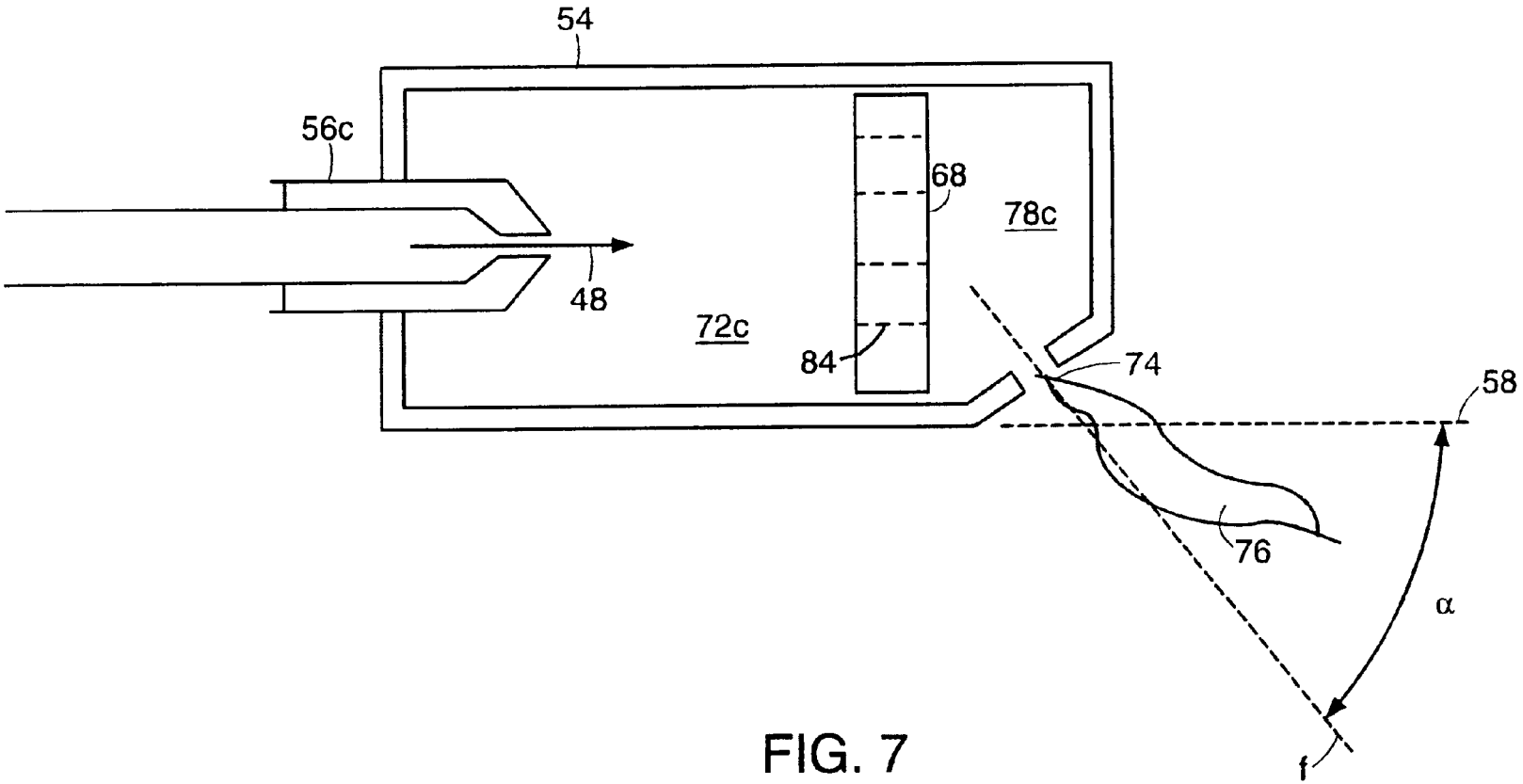
FIG. 7 illustrates a cutaway side view of a burner assembly according to the invention.

FIG. 7 illustrates a cut-away elevation view of the burner manifold 54 (taken along section 7—7 of FIG. 6). Gas 48 flows through the burner nozzle 56*c* and into primary chamber 72*c*. The gas 48 then flows through holes 84 in the diffuser plate 68, and into secondary chamber 78*c*. The gas 48 then flows through the exit slot 74 and ignites when it mixes with sufficient oxygen. The direction that the flame exits the burner manifold 54 is indicated by "f", which is disposed at an angle relative to imaginary line 58 (as defined above with reference to FIG. 2). Angle, as discussed above, is between 0° and 90°, and more preferably between 20° and 70°. FIG. 7 illustrates the imaginary line 58 being coincident with the bottom surface of the burner manifold 54. However, the imaginary line 58 may not be coincident with the bottom surface of the burner manifold 54.

Figure 8A:
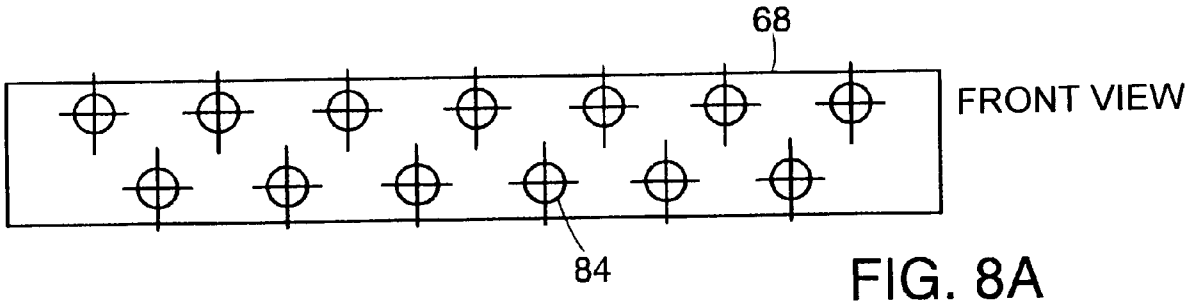
FIG. 8 illustrates two views of a diffuser plate.
Figure 8B:
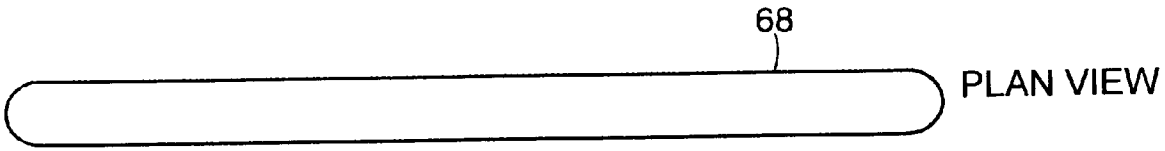

FIG. 8 illustrates two views of a diffuser plate 68. As can be seen in the front view of FIG. 8, the diffuser plate 68 has thirteen holes 84. A diffuser plate 68 may have more or fewer holes 84 than shown. Also, the arrangement and size of the holes 84 may be different than what is shown. A plan view of the diffuser plate 68 is also shown.

Figure 9:
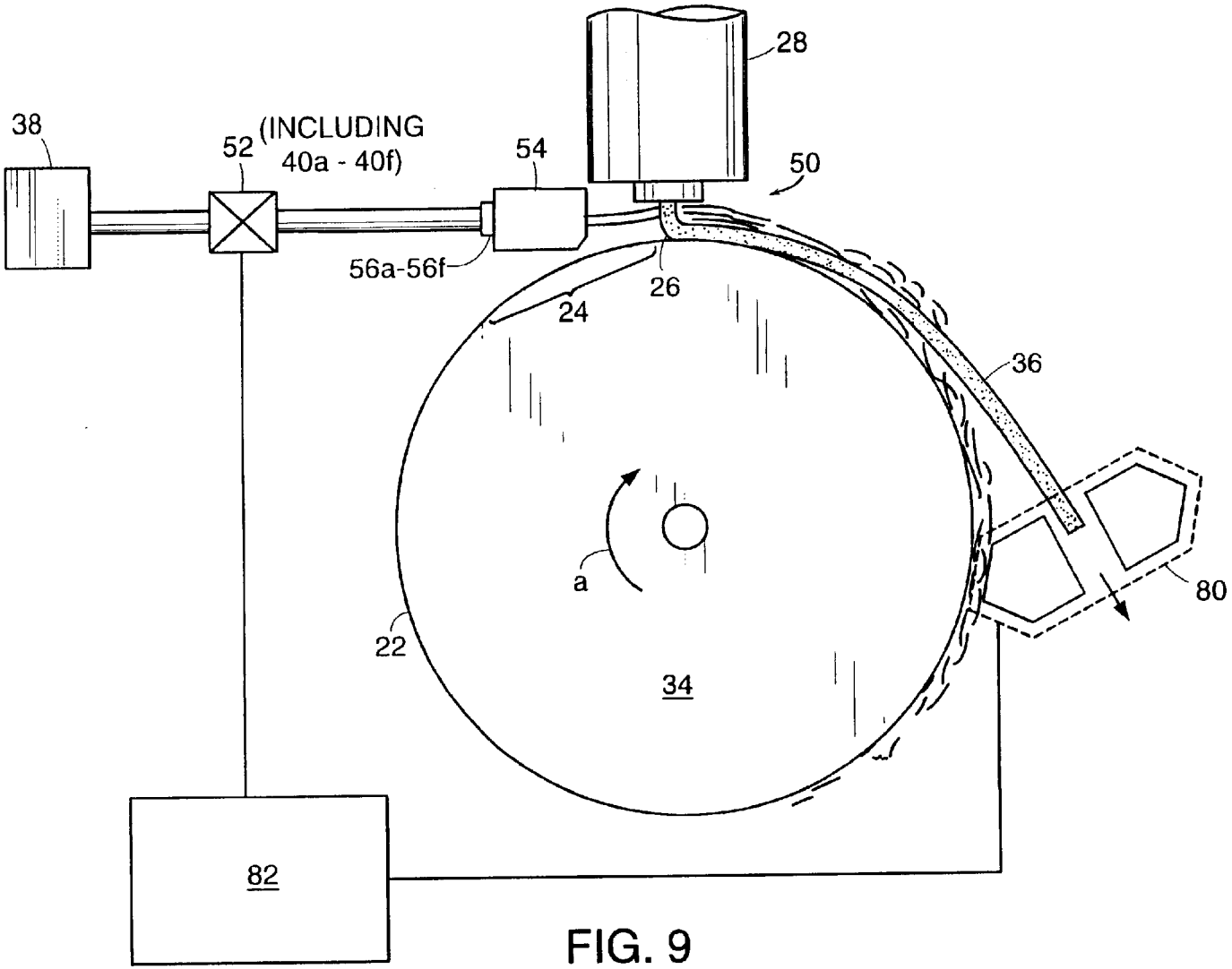
FIG. 9 illustrates a casting system according to the invention implementing control functions.

FIG. 9 illustrates a particular embodiment of a system for controlling the techniques described herein. A sensor 80 monitors the quality (e.g. thickness and uniformity of the thickness across the width, etc.) of the cast metal strip 36. The sensor 80 may, for example, be an x-ray sensor, but any sensor 80 appropriate for evaluating the desired quality can be used. The sensor 80 generates a signal representing quality of the cast strip 36 and sends that signal to a controller 82. Ideally, the sensor 80 is capable of measuring the full transverse width of the cast metal strip 36. The controller 82 may be, for example, a programmable computer, a dedicated circuit, or a dedicated controller. The controller 82 provides a control signal to the gas valves 40*a*–40*f* in the gas valve manifold 52. The gas valves' 40*a*–40*f* positions and hence the gas flow rates, are adjusted responsive to the signal received from the controller 82. The control signal may be, for example, a pneumatic signal, a mechanical signal, an electrical signal, or any other convenient type of signal. Additionally, the controller 82 may also include provisions for recording the operation of the sensor 80 and/or the system over an interval of time.

Proper selection of the reducing gas is important. The combustion product of the burned gas should not produce an appreciable amount of liquid or solid phase, which may undesirably precipitate onto the quench surface 22 or the casting nozzle 28, thereby adversely affecting metal strip 36 casting and/or properties. For example, hydrogen gas has performed unsatisfactorily under ordinary conditions because a combustion product of hydrogen is water, which may condense onto a quench surface 22. As a result, the hydrogen flame plume often does not adequately reduce the formation of gas pockets 32 on the quench surface 22 side of the strip 36.

The reducing gas is preferably a gas that will not only burn and consume oxygen in a strongly exothermic reaction, but one that will also produce combustion products that will remain in a gaseous state at the temperature and pressure conditions at the casting surface. Carbon monoxide (CO) gas is a preferred gas in that it satisfies the above criteria. Carbon monoxide also provides a desirable, anhydrous, reducing atmosphere. However, other gases, such as various carbon monoxide blends that include small amounts of oxygen, hydrogen and/or various hydrocarbons may be used. Other gases may provide certain advantages, such as, higher flame temperatures, more reactive (i.e. deoxidizing) gas or lower expenses.

It is also advantageous to regulate several other pertinent factors, such as, the composition of the hot, low-density atmosphere, and other parameters at quench surface 22, to substantially prevent the formation of any solid or liquid matter, which could precipitate onto the quench surface 22. Such precipitation, if entrained between the melt puddle 30 and the quench surface 22, could produce surface defects and degrade the strip 36 quality.

Desirably, heat produced by the low density reducing gas 48 located proximate to the quenching region 26 does not degrade the quenching of the molten metal. Rather, the heat produced by the exothermic reduction reaction actually improves the uniformity of the quench rate by minimizing the presence of insulating, entrapped gas pockets 32, and thereby improves the quality of the cast strip 36.

The low density reducing atmosphere formed as the combustion product of a gas provides an efficient means for heating the region located proximate to a melt puddle 48 to very high temperatures, in the order of about 1200–1500 K, and provides a very low density gas atmosphere around the melt puddle 30. The high temperatures also increase the kinetics of the reduction reaction to further minimize oxidation on the quench surface 22, the casting nozzle 28, and the strip 36. The presence of a hot reducing flame at the casting nozzle 28 also reduces thermal gradients therein, which might otherwise crack the casting nozzle 28.

Rapid quenching employing conditions described heretofore, can be used to obtain a metastable, homogeneous, ductile material. The metastable material may be glassy, in which case there is no long range order. X-ray diffraction patterns of glassy metal alloys show only a diffuse halo, similar to that observed for inorganic oxide glasses. Such glassy alloys must be at least 50% glassy to be sufficiently ductile to permit subsequent handling, such as stamping complex shape from ribbons of the alloys. Preferably, the glassy metal alloys must be at least 80% glassy, and most preferably substantially (or totally) glassy, to attain superior ductility.

The material of the invention is advantageously produced in foil (or ribbon) form, and may be used in product applications as cast, whether the material is glassy or microcrystalline. Alternatively, foils of glassy metal alloys may be heat treated to obtain a crystalline phase, preferably fine-grained, in order to promote longer die life when stamping of complex shapes is contemplated.

Particularly useful amorphous metals include those defined by the formula:

$$M_{70\text{-}85}\ Y_{5\text{-}20}\ Z_{0\text{-}20}$$

wherein the subscripts are in atomic percents, "M" is at least one of Fe, Ni and Co. "Y" is at least one of B, C and P, and "Z" is at least one of Si, Al and Ge; with the proviso that (i) up to 10 atom percent of component "M" can be replaced with at least one of the metallic species Ti, V, Cr, Mn, Cu, Zr, Nb, Mo, Ta and W, and (ii) up to 10 atom percent of components (Y+Z) can be replaced by at least one of the non-metallic species In, Sn, Sb and Pb. Such amorphous metal transformer cores are suitable for use in voltage conversion and energy storage applications for distribution frequencies of about 50 and 60 Hz as well as frequencies ranging up to the gigahertz range.

The presence of an independently adjustable reducing atmosphere at a quench surface 22 has distinct advantages. First, independent influencing of discrete sections of a strip's thickness profile can be accomplished. Also, a low density reducing atmosphere minimizes the oxidation of the strip 36. In addition, the low density reducing atmosphere starves the quench surface 22 of oxygen and minimizes the oxidation thereof. The reduced oxidation improves the wettability of the quench surface 22 and allows molten metal to be more uniformly deposited on the quench surface 22. In the case of copper based materials in the quench surface 22, the reduced oxidation renders the quench surface 22 much more resistant to thermally induced fatigue crack nucleation and growth. The low density reducing atmosphere also depletes oxygen from the region of the casting nozzle 28, thereby reducing clogging of the casting nozzle 28, which might otherwise clog due to the accumulation of oxide particulates.

Another advantage that casting systems implementing the techniques described herein may realize is that discrete nozzles may be closed when casting narrower strips. This may result in an advantageous savings in gas. These and other advantages will be apparent from the following examples.

EXAMPLES

A casting system, according to the invention, was studied for its effect on ribbon thickness profiles while casting.

A burner was fabricated as per FIGS. 4–8, with six independently controlled gas valves, nozzles and combustion chambers, each combustion chamber approximately 2 inches wide. An attempt was made to use this burner to control the ribbon thickness profile in discrete sections of the ribbon, without significantly influencing other sections, by adjusting the gas flow only in discrete sections.

First, the flow of gas through all six nozzles was adjusted so that all nozzles were supplying equal gas flows (approximately 10 liters/minute-nozzle). System adjustments were made to make the cast as good as possible without changing gas flows in the independently controllable zones. The best cast that could be achieved was obtained. An x-ray device was used to scan the thickness profile across the width of the cast strip. The x-ray device was configured to pass across the width of the strip as the strip moved past the x-ray device. Therefore, all thickness profile scans obtained actually represent diagonal cross-sections of the strip.

Figure 10:
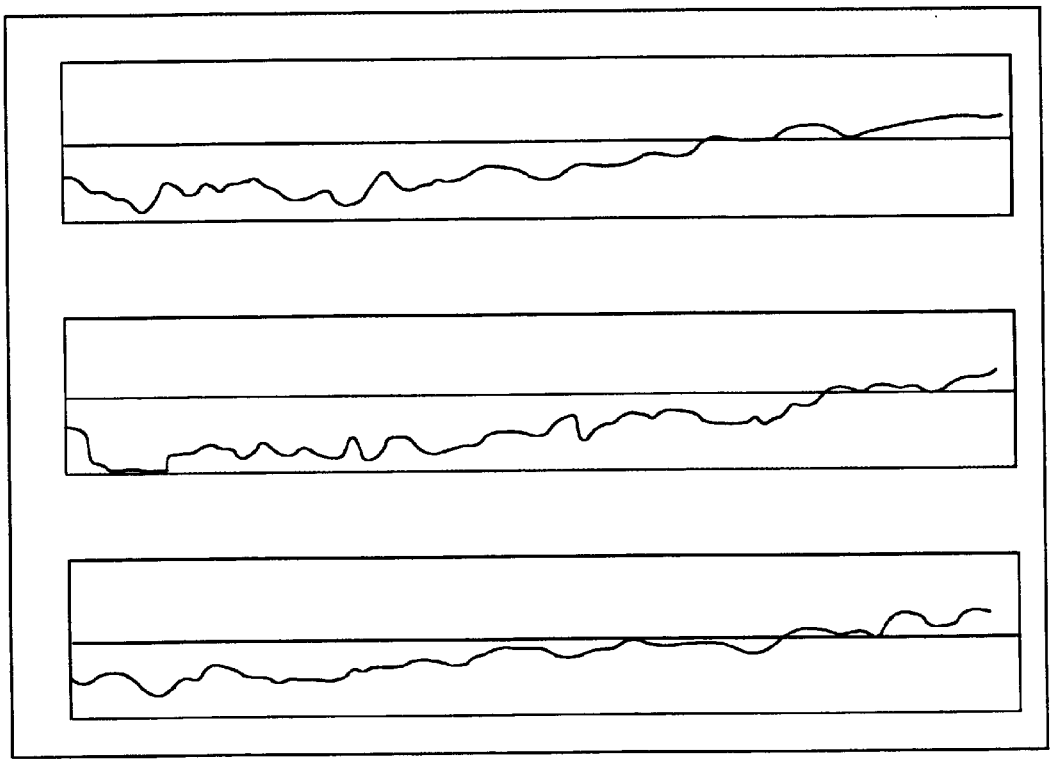
FIG. 10 illustrates three exemplary thickness profiles of a cast strip according to the invention.

FIG. 10 illustrates three thickness profile scans obtained with each independently controllable nozzle supplying gas at the same rate (approximately 10 liters/minute). The ordinate (perpendicular axis) represents the strip's thickness at a given point, and the abscissa (horizontal axis) indicates the location across the strip's width. The x-ray device was fitted with an edge sensor that sensed the edge of the strip to ensure it did not pass the edge. The x-ray device was adjusted to scan from one edge of the strip to the other edge of the strip. The horizontal straight line in the center of each scan indicates an "ideal" cast thickness profile. The inboard side of the casting surface is on the left side of the page and the outboard side of the casting surface is on the right side of the page. The inboard side of the casting surface is the side of the casting surface where the cooling medium enters it. The outboard side of the casting surface is the side of the casting surface where the cooling medium leaves the casting surface.

The trends of the three thickness profiles illustrated in FIG. 10 show wedge profiles, with a relatively thin profile on the inboard side and the thickness increasing towards the outboard side. The wedge profile could not be corrected without adjusting the gas flow rates to different levels in the independently controllable zones of the burner assembly. Two casting parameters were also measured: the lamination factor (LF) and the thickness variation (TV). Lamination factor (LF) can be defined as the fraction of a rectangular cross-section that is filled by metal. Higher values of LF are desirable and indicate that space is efficiently filled by metal. An ideal LF value is 1.0. Thickness variation (TV) can be defined as the ratio of the maximum thickness of a strip to the minimum thickness of the strip. Lower TV values are desirable and indicate that a strip is uniformly thick. An ideal TV value is 1.0. The measured LF was 0.79 and the measured TV was 1.35.

Figure 11A:
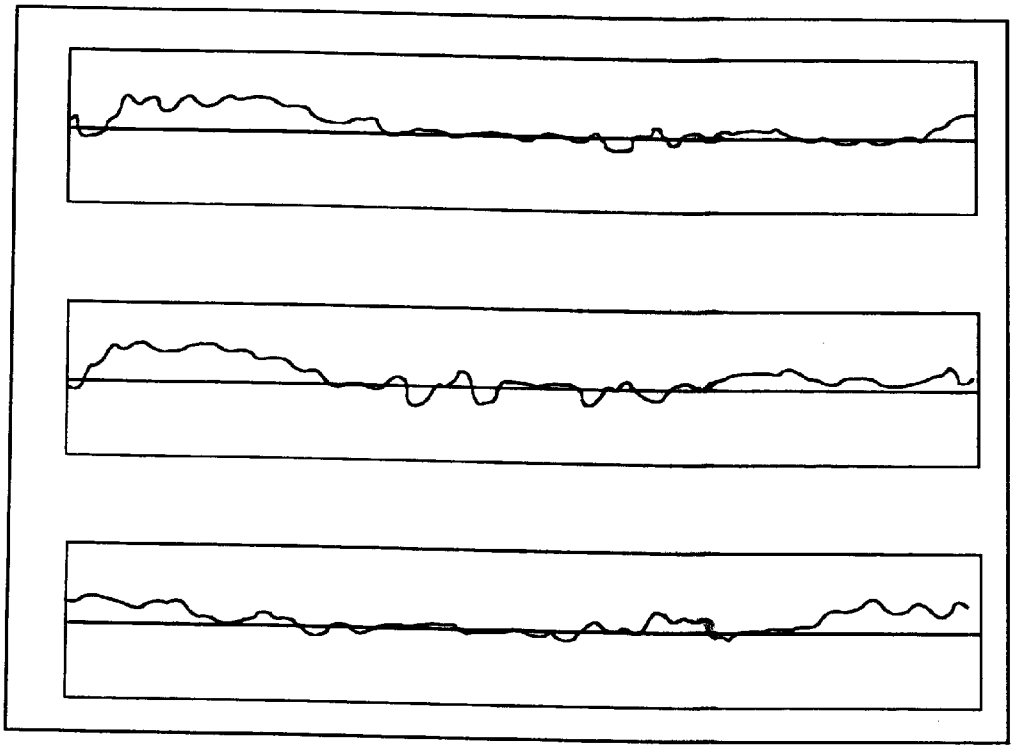
FIGS. 11A–11B illustrates exemplary thickness profiles of a cast strip according to the invention.

FIG. 11A illustrates three thickness profile scans obtained after making adjustments to the flow rates to each of the independently controllable burner zones. The gas flow rate to the inboard most zone was doubled and the gas flow rates to all other zones was increased somewhat. These three scanned thickness profiles are significantly different than the three scanned thickness profiles shown in FIG. 10. The three scanned thickness profiles of FIG. 11A more closely follow the "ideal" thickness profile. The effect of adjusting the gas flow to the independently controllable zones was very rapid. Instead of having a wedge thickness profile (as shown in FIG. 10), the cast now had a slight dish profile. The measured LF was 0.83 and the measured TV was 1.16. Both of these parameters had been improved by adjusting the independently controllable burner zones. Also, it was noted that the wedge profile was substantially corrected by adjusting the gas flow rates.

Figure 11B:
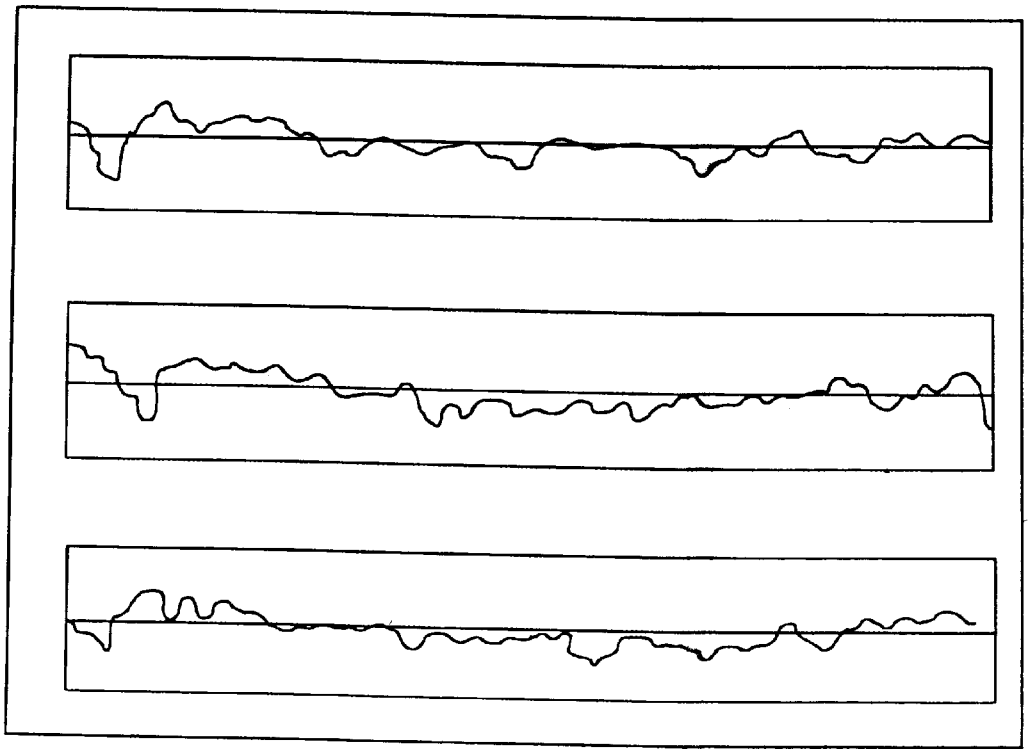

FIG. 11B illustrates three thickness profile scans obtained approximately 67 seconds after making the adjustments described above to the gas flow rates of the independently controllable burner zones. It can be noted that the trends of the scanned thickness profiles in FIG. 11B are substantially similar to the trends of the scanned thickness profiles in FIG. 11A. LF and TV were measured again. LF was 0.82 and TV was 1.26. These values changed very little from when they were measured during the scans of FIG. 11A. It can be concluded that the scanned thickness profiles in FIG. 11A represent a substantially steady state condition.

Other adjustments were made to the gas flow rates in an attempt to induce and then correct several well known thickness profiles, as described below. The thickness profiles of FIG. 11A can be used as a baseline condition for comparing the other thickness profiles obtained after making these other adjustments.

Figure 12A:
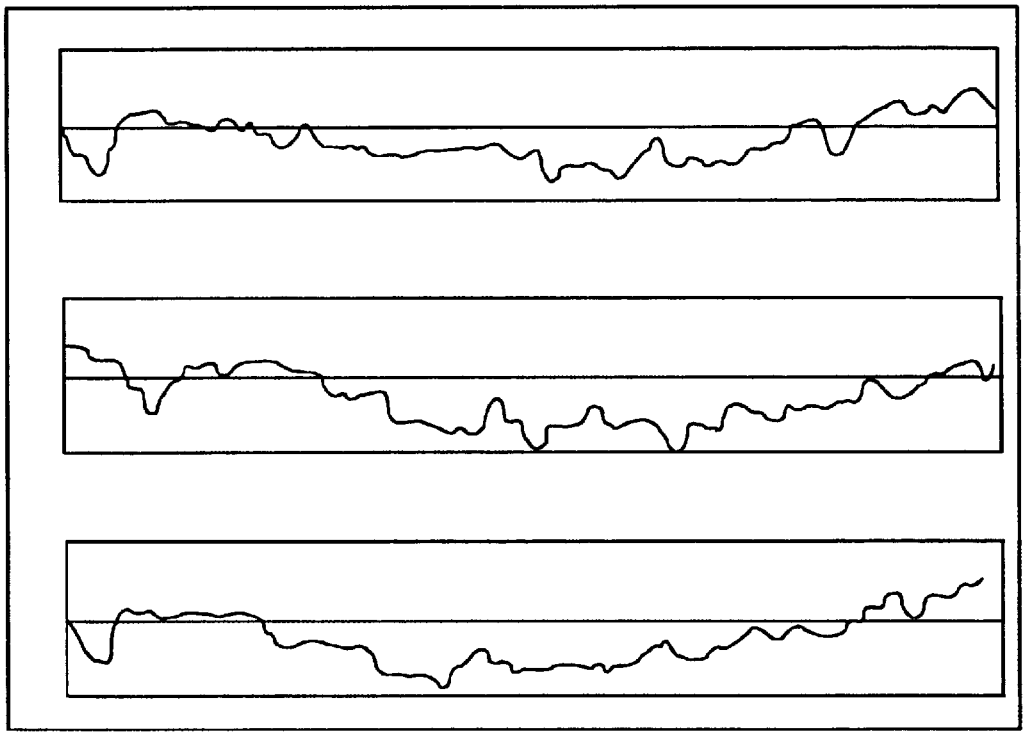
FIGS. 12A–12B illustrates exemplary thickness profiles of a cast strip according to the invention.

FIG. 12A illustrates three thickness profile scans obtained after turning off the gas flow to the two center independently controllable nozzles. The slight dish profile, shown in FIG. 11A, was worsened. The measured LF was 0.78 and the measured TV was 1.31. These parameters were made worse than the baseline condition.

Figure 12B:
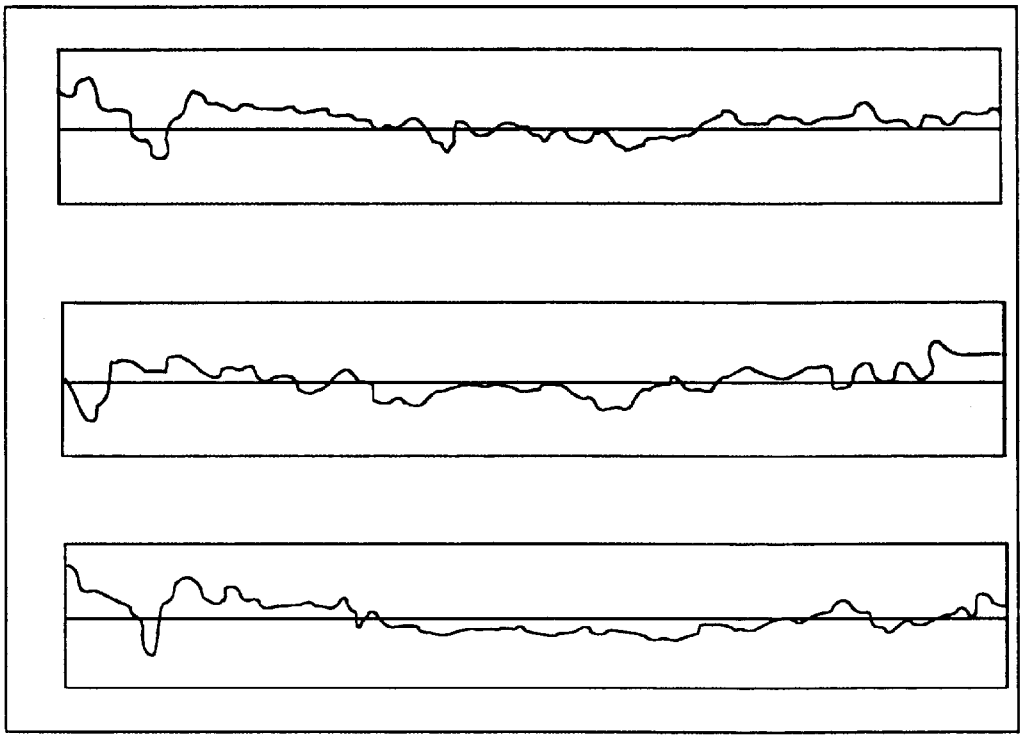

FIG. 12B illustrates three thickness profile scans obtained after returning the gas flow rates to the baseline values. The dish profile was substantially corrected by making this adjustment. It can be concluded that the effect of adjusting the gas flow rate in independently controllable zones was reversible. It also appeared that a cast ribbon could be made thinner in a particular zone by decreasing the gas flow rate to that zone.

Figure 13:
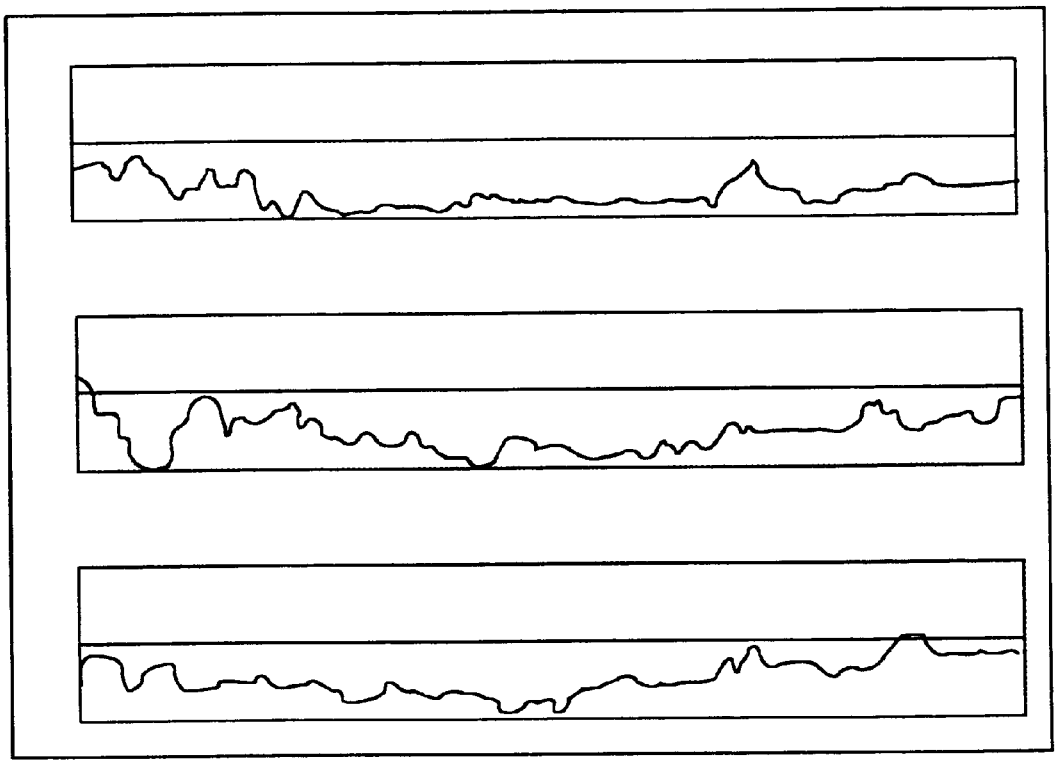
FIG. 13 illustrates three exemplary thickness profiles of a cast strip according to the invention.

FIG. 13 illustrates three thickness profile scans obtained after shutting off gas flow to the center four zones. The dish profile had been further worsened. The measured LF was 0.8 and the measured TV was 1.37. These parameters had both been worsened. This operating condition resulted in breakouts, and the cast was stopped. A new baseline casting condition had to be established.

Figure 14:
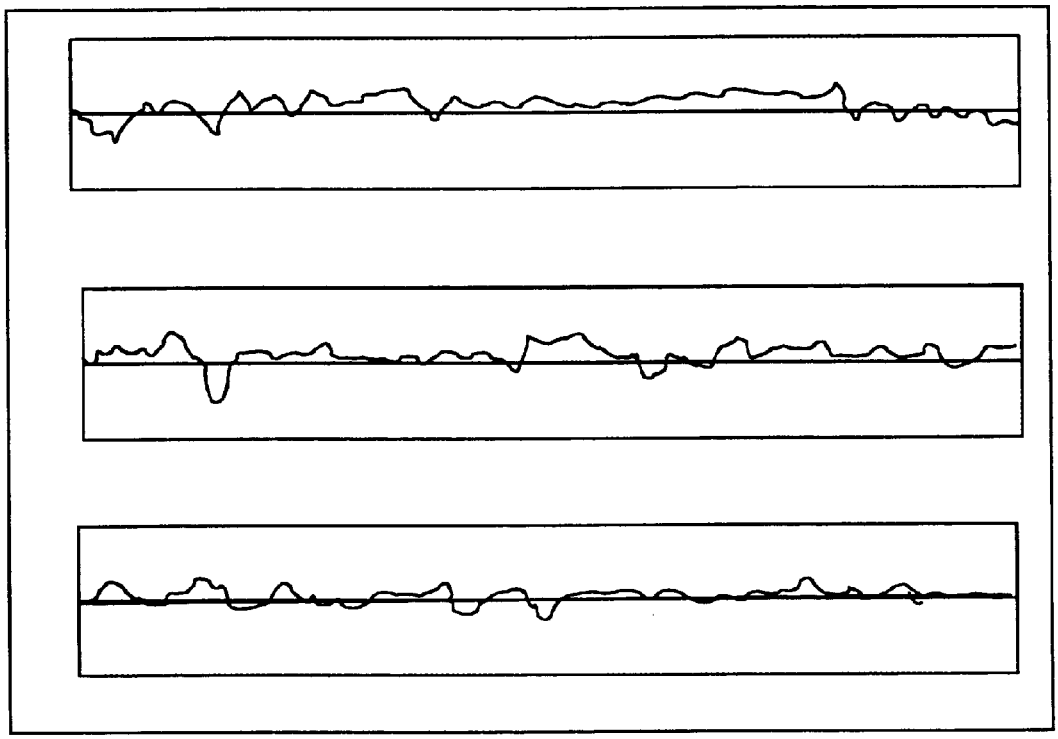
FIG. 14 illustrates three exemplary thickness profiles of a cast strip according to the invention.

FIG. 14 illustrates three x-ray thickness profile scans representing a new baseline casting condition that was established after starting a new cast following the breakouts. The measured LF was 0.86 and the measured TV was 1.24. These profiles had a slight D-profile.

Figure 15A:
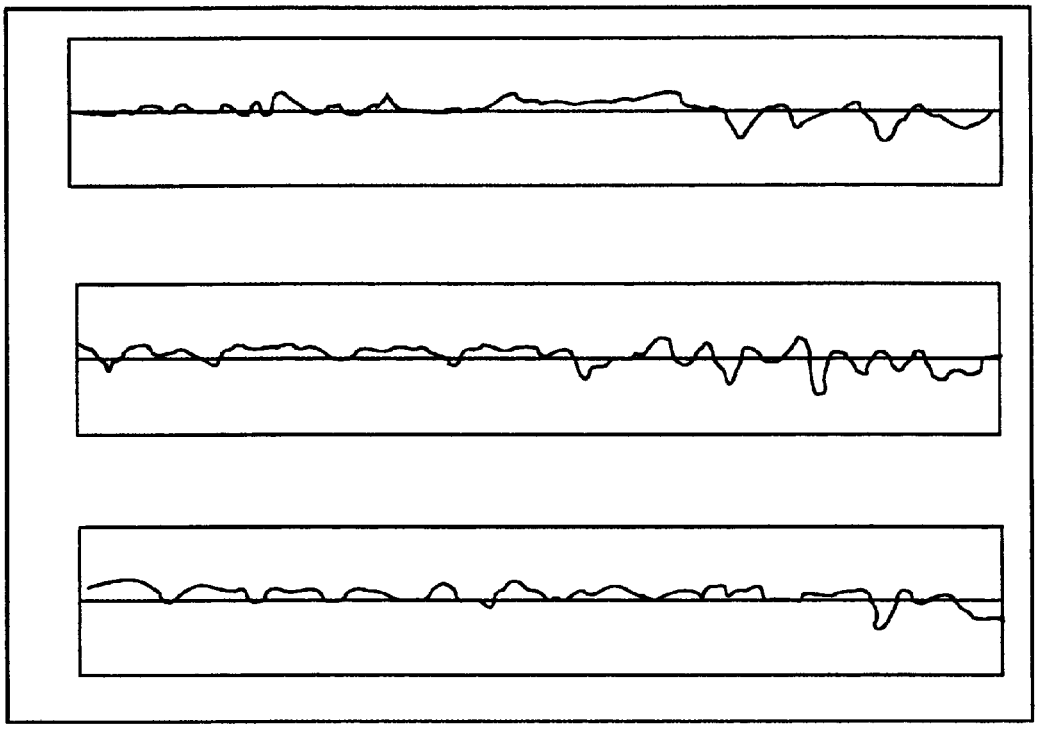
FIGS. 15A–15B illustrates exemplary thickness profiles of a cast strip according to the invention.

FIG. 15A illustrates three x-ray thickness profile scans obtained after shutting off gas flow to the two outer zones. These two outer zones were outside of the edges of the cast ribbon and seem to have only a minor effect on the thickness profile. However, a slight worsening of the D-profile was induced in the cast. The measured LF was 0.84 and the measured TV was 1.18. These values were made worse.

Figure 15B:
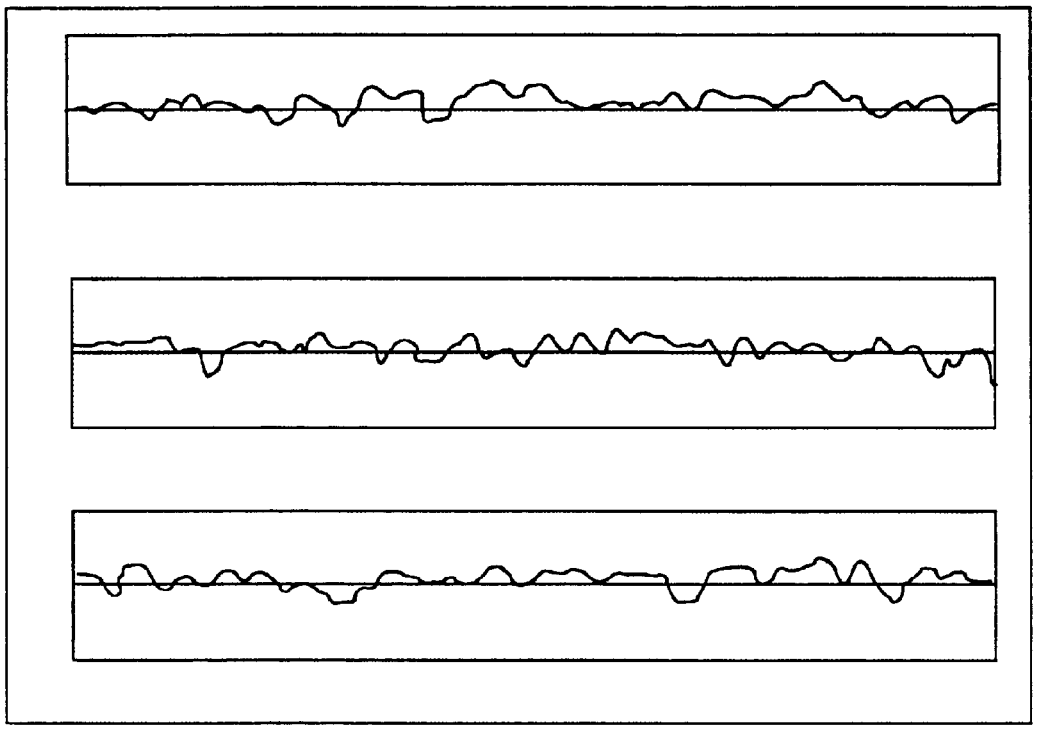

FIG. 15B shows a return to approximately the gas flow rate conditions that existed when the scans of FIG. 14 were recorded. The D-profile was slightly corrected. This new baseline casting condition resulted in an LF of 0.85 and a TV of 1.15.

Figure 16A:
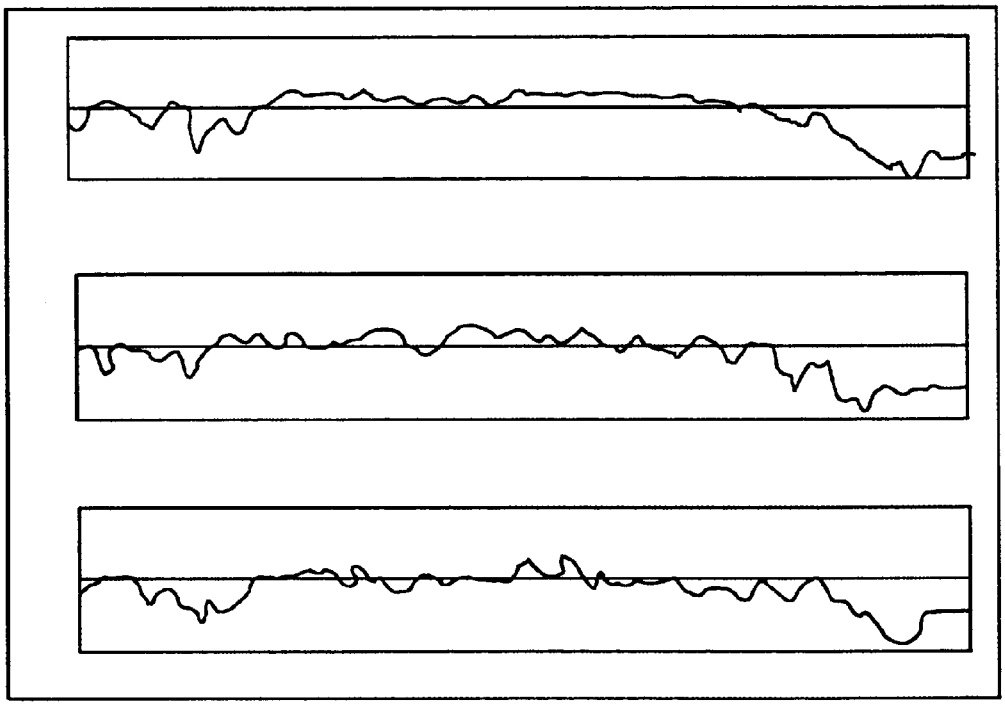
FIGS. 16A–16B illustrates exemplary thickness profiles of a cast strip according to the invention.

FIG. 16A illustrates three x-ray thickness profile scans obtained after shutting off gas flow to the four outer zones. A significant D-profile was induced, especially on the outboard side. The measured LF was 0.78 and the measured TV was 1.31.

Figure 16B:
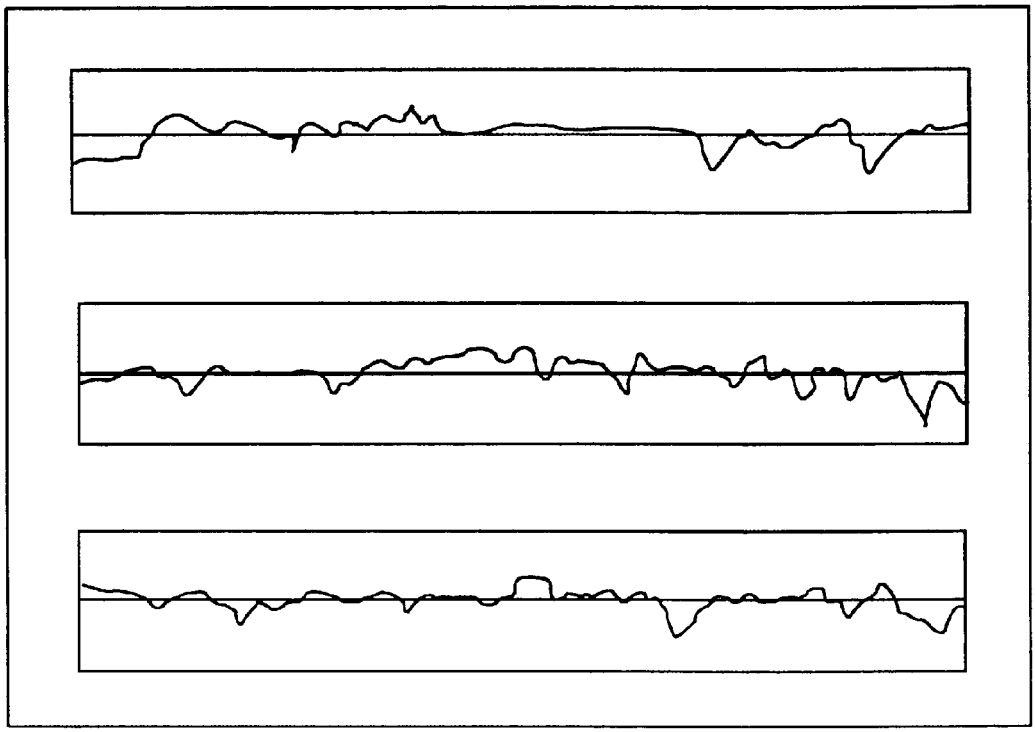

FIG. 16B shows a return to baseline gas flow conditions. The D-profile was mostly corrected. The measured LF was 0.83 and the measured TV was 1.24.

Figure 17A:
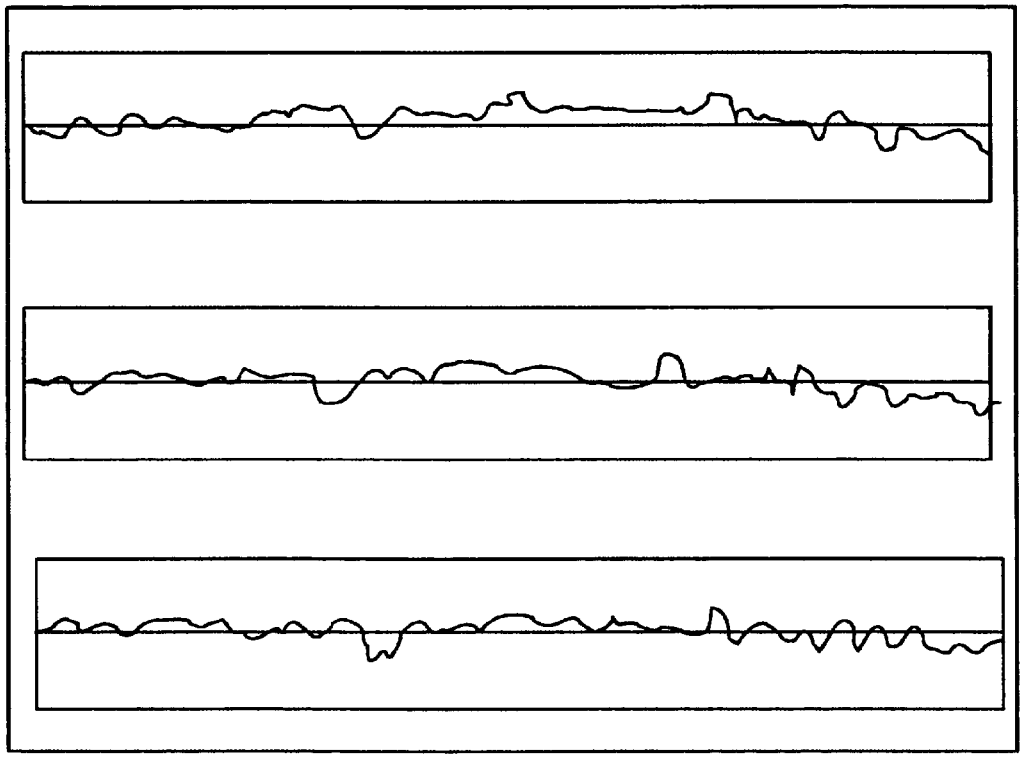
FIGS. 17A–17B illustrates exemplary thickness profiles of a cast strip according to the invention.

FIG. 17A illustrates three x-ray thickness profile scans obtained after adjusting the gas flow to increase gas flow to the inboard side and to decrease gas flow to the outboard side. This induced a slight wedge profile with a thinner outboard side and a thicker inboard side. This effect was more noticeable on the outboard side. LF was 0.83 and TV was 1.31.

Figure 17B:
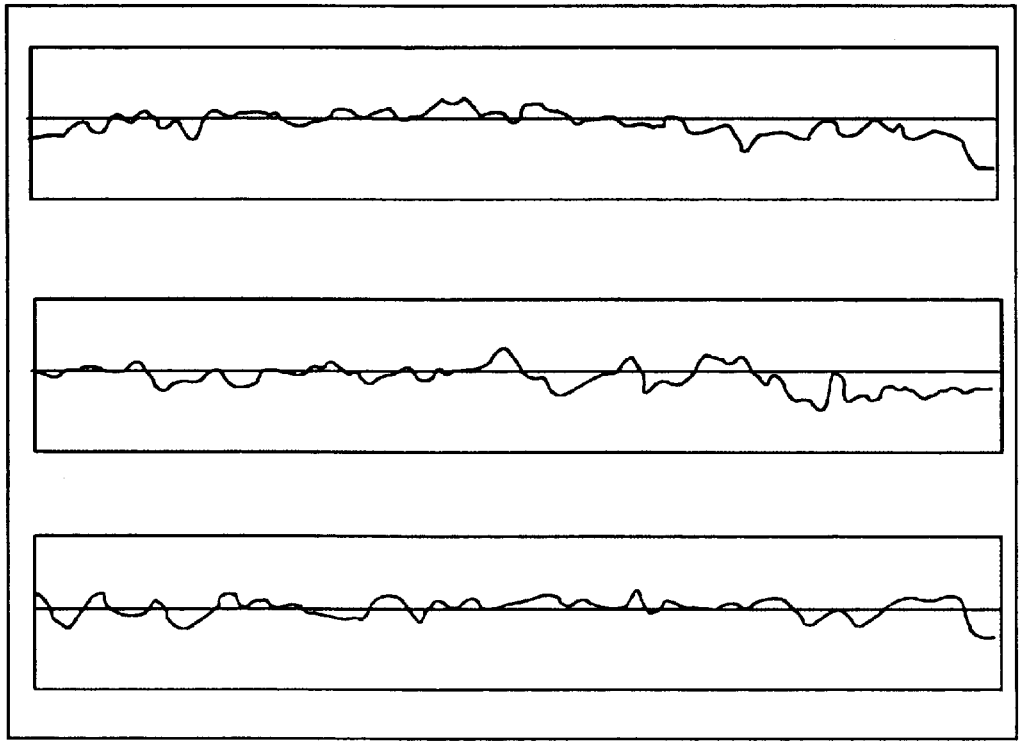

FIG. 17B shows a return to baseline gas flow rates. The slight wedge profile was mostly corrected. LF was 0.84 and TV was 1.22.

Figure 18A:
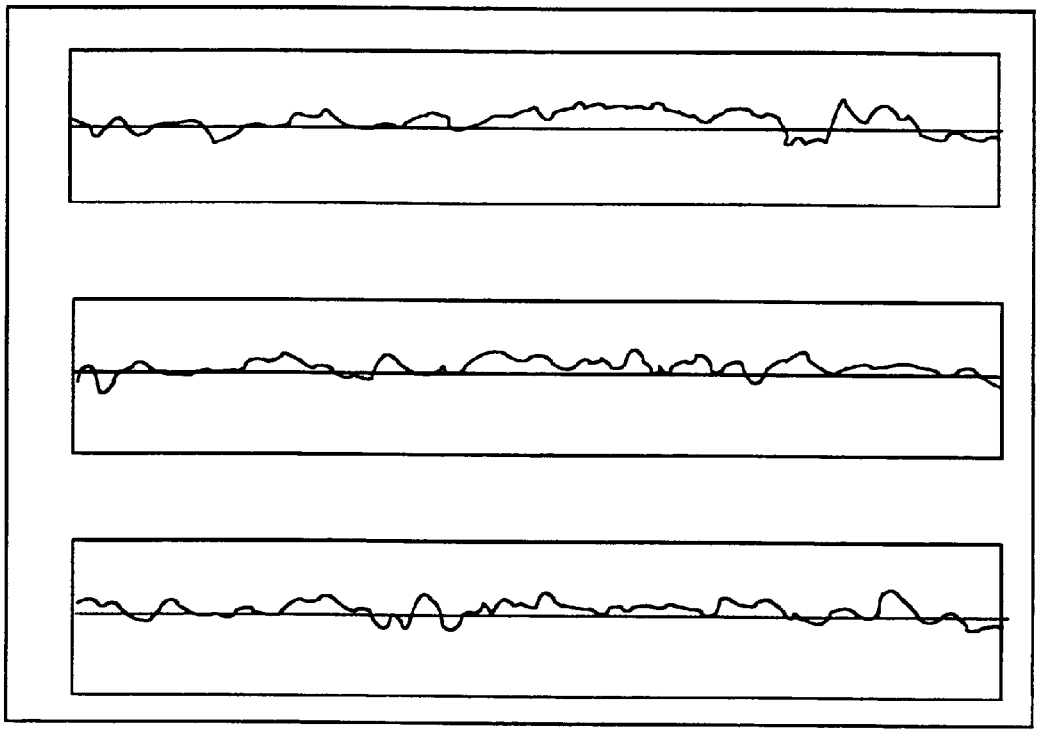
FIGS. 18A–18B illustrates exemplary thickness profiles of a cast strip according to the invention.

FIG. 18A illustrates three thickness profile scans obtained after adjusting the gas flow rates to increase gas flow to the outboard side and to decrease gas flow to the inboard side. This induced a slight wedge profile with a thicker outboard side and a thinner inboard side. The measured LF was 0.84 and the measured TV was 1.16.

Figure 18B:
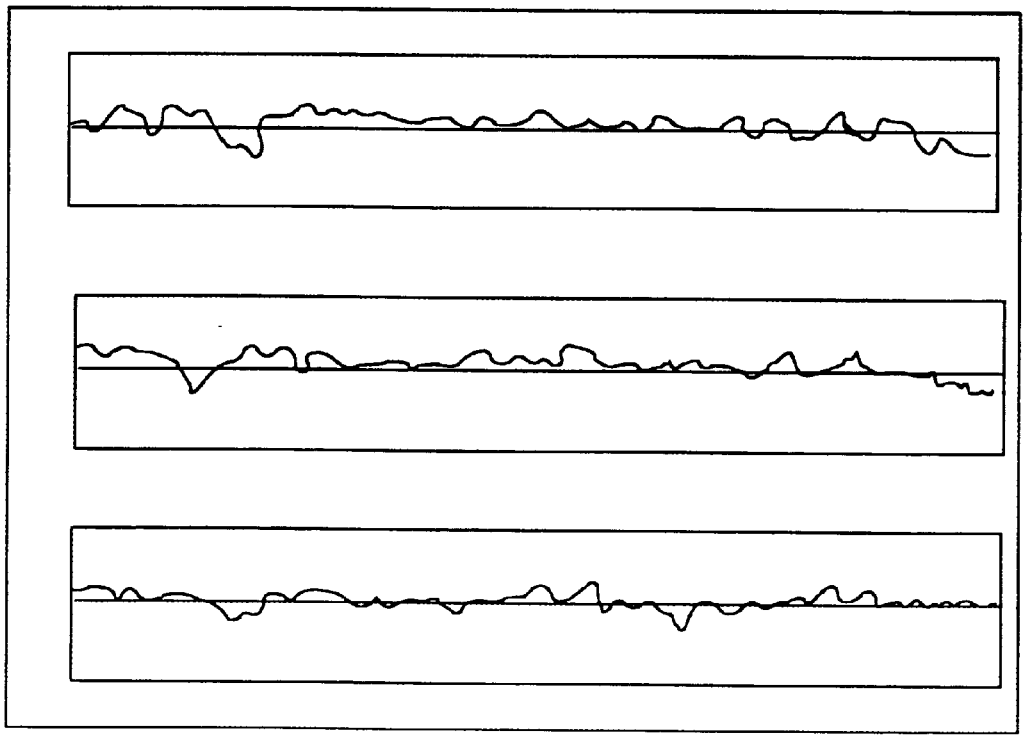

FIG. 18B shows a return to baseline gas flow rates. The slight wedge profile was mostly corrected. The measured LF was 0.85 and the measured TV was 1.17.

It was determined that the implementation of techniques according to the invention was successful in inducing and subsequently correcting several common profiles found in casting today, including dish profiles, D-profiles, and wedge profiles; some more significantly than others. The effect of this influence was generally very rapid and steady state conditions were reached very quickly. The effect of this influence was also determined to be reversible.

What is claimed is:

1. An apparatus for casting metal strip comprising:

a casing with one exit slot;

a plurality of baffles defining discrete compartments within the casing;

a plurality of nozzles extending into each discrete compartment; and an igniting device for igniting a gas that flows trough the gas nozzles.

2. The apparatus of claim 1 further comprising at least one diffuser plate.

3. The apparatus of claim 2 wherein at least one discrete compartment includes a diffuser plate.

4. The apparatus of claim 3, wherein a gas flows through said discrete compartment and said diffuser plate is substantially perpendicular to said gas flow.

5. The apparatus of claim 3, wherein at least one discrete compartment includes plural diffuser plates.

6. The apparatus of claim 2 wherein each discrete compartment includes a diffuser plate.

7. The apparatus of claim 1, wherein a plurality of gas nozzles extends into at least one of said discrete compartments.

8. The apparatus of claim 1, further comprising a plurality of gas valves, each of said valves being in communication with one of said gas nozzles.

9. The apparatus of claim 8, wherein said valves are independently controllable.

10. The apparatus of claim 1, said apparatus having a bottom surface, and said exit slot being oriented to direct gas flow at an angle "$\alpha$," said angle ranging from about 0 to 90° and being measured from an imaginary line coincident with said bottom surface.

11. The apparatus of claim 10, said angle ranging from about 20 to 70°.

* * * * *